US009388564B2

(12) United States Patent
Ros Garcia et al.

(10) Patent No.: US 9,388,564 B2
(45) Date of Patent: Jul. 12, 2016

(54) MODULAR ADAPTABLE HOUSING ARCHITECTURE

(71) Applicant: AIRBUS DEFENCE AND SPACE, S.A., Madrid (ES)

(72) Inventors: Juan Manuel Ros Garcia, Madrid (ES); Javier Camacho Diez, Madrid (ES); Luis Casillas Gamboa, Madrid (ES); Carlos Miguel Iglesias Sanz, Madrid (ES)

(73) Assignee: Airbus Defense And Space, S.A., Madrid (ES)

( * ) Notice: Subject to any disclaimer, the term of this patent is extended or adjusted under 35 U.S.C. 154(b) by 0 days.

(21) Appl. No.: 14/764,022

(22) PCT Filed: Jan. 23, 2014

(86) PCT No.: PCT/ES2014/070044

§ 371 (c)(1),
(2) Date: Jul. 28, 2015

(87) PCT Pub. No.: WO2014/114836

PCT Pub. Date: Jul. 31, 2014

(65) Prior Publication Data

US 2015/0368893 A1 Dec. 24, 2015

(30) Foreign Application Priority Data

Jan. 28, 2013 (ES) ..... 201330097

(51) Int. Cl.
*E04B 1/12* (2006.01)
*E04B 1/343* (2006.01)
(Continued)

(52) U.S. Cl.
CPC ..... *E04B 1/34326* (2013.01); *E04B 1/19* (2013.01); *E04B 1/3205* (2013.01);
(Continued)

(58) Field of Classification Search
CPC ..... E04B 1/19; E04B 1/3205; E04B 1/34326; E04F 15/04; E04F 15/105; E04F 15/02038; E04H 1/02; E04H 1/18; E04H 1/36; E04H 1/56; E04H 1/005
USPC ..... 52/63, 79.1, 80.2, 81.2, 85, 86, 87, 89
See application file for complete search history.

(56) References Cited

U.S. PATENT DOCUMENTS 2,292,078 A * 8/1942 Inman ..... E04B 1/342 135/116
3,415,260 A * 12/1968 Hall ..... B60P 7/02 135/129
3,464,168 A * 9/1969 Lyons, Jr. ..... E04B 1/3205 52/223.7
(Continued)

*Primary Examiner* — James Buckle, Jr.
(74) *Attorney, Agent, or Firm* — Dickinson Wright PLLC

(57) ABSTRACT

A modular adaptable housing architecture for building temporary shelters and residential units in emergency situations is provided and includes an oval cross-section, which can be increased and extended in a flexible manner, involving the mechanically articulated assembly of successive structural modules formed by pairs of crosswise-arranged ovoid frames in order to support a panel-based inner floor slab, with the shell being formed by sheets, while providing a level floor solution in which the floor is elevated above the ground using the curvature of the elliptical supporting section of each frame or retractable supporting parts of the frames. The result is a self-tensioning geometry shelter, which can be adapted to suit the terrain and occupancy requirements, which is stable, strong and environmentally friendly, and which can be transported in disassembled parts and quickly assembled at any location without requiring any additional work and enabling a finish typical of the locality.

13 Claims, 12 Drawing Sheets

Figure 1:
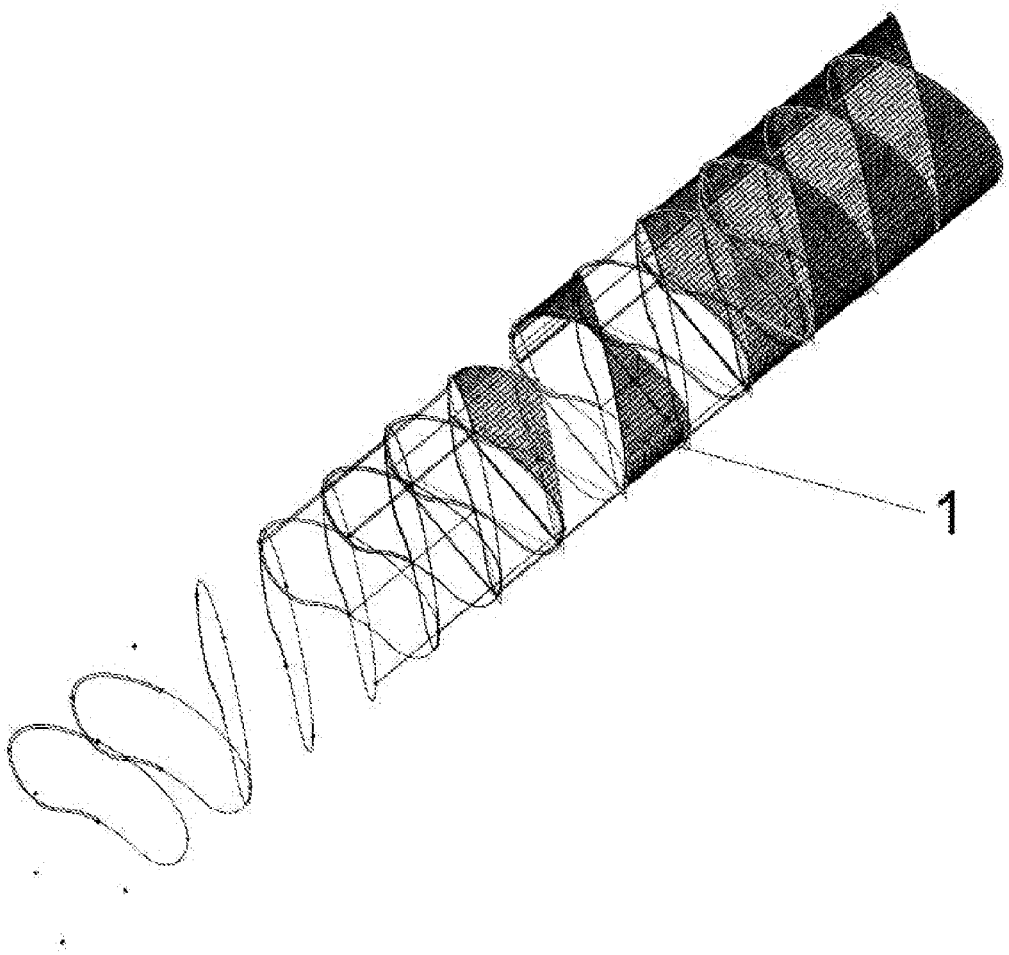

(51) Int. Cl.

| | |
|---|---|
| ***E04H 15/56*** | (2006.01) |
| ***E04H 15/18*** | (2006.01) |
| ***E04H 15/36*** | (2006.01) |
| ***E04B 1/32*** | (2006.01) |
| ***E04B 1/19*** | (2006.01) |
| ***E04F 15/02*** | (2006.01) |
| ***E04F 15/04*** | (2006.01) |
| ***E04F 15/10*** | (2006.01) |
| ***E04H 1/00*** | (2006.01) |
| ***E04H 1/02*** | (2006.01) |

(52) U.S. Cl.
CPC ..... *E04F 15/02038* (2013.01); *E04F 15/04* (2013.01); *E04F 15/105* (2013.01); *E04H 1/005* (2013.01); *E04H 1/02* (2013.01); *E04H 15/18* (2013.01); *E04H 15/36* (2013.01); *E04H 15/56* (2013.01)

(56) References Cited

U.S. PATENT DOCUMENTS

| | | | | | |
|---|---|---|---|---|---|
| 3,909,993 | A * | 10/1975 | Huddle | E04B 1/3205 | 135/117 |
| 4,280,306 | A * | 7/1981 | Milinic | E04H 15/18 | 135/906 |
| 5,381,634 | A * | 1/1995 | Pietrogrande | A01F 25/13 | 135/138 |
| 6,085,468 | A * | 7/2000 | Quiring | E04B 1/19 | 52/273 |
| 7,628,166 | B2 * | 12/2009 | Carter | E04H 15/50 | 135/124 |
| 7,726,078 | B2 * | 6/2010 | Kolozsvary-Kiss | E04H 7/14 | 52/80.1 |
| 7,814,714 | B2 * | 10/2010 | McGary | E04H 7/22 | 52/192 |
| 2004/0238021 | A1 * | 12/2004 | Holub | E04H 15/18 | 135/97 |
| 2011/0271607 | A1 * | 11/2011 | Saura Garcia | B66B 31/00 | 52/63 |

* cited by examiner

MODULAR ADAPTABLE HOUSING ARCHITECTURE

CROSS REFERENCE TO RELATED APPLICATION

This application claims the benefit of PCT International Application Ser. No. PCT/ES2014/070044 filed on Jan. 23, 2014 and is entitled a "MODULAR ADAPTABLE HOUSING ARCHITECTURE," which claims benefit of Application No. P201330097 filed Jan. 28, 2013.

The object of the present invention is a new architecture for adaptable housing for social emergencies, that is, to build shelters or temporary residential units wherever an accident, disaster or other unexpected event that requires temporarily housing the people affected, to result afterwards in being removed with minimal environmental impact.

Shelters resulting from this new architecture are basically housing units having an oval cross-section, which can be increased and extended in a flexible manner, through the mechanically articulated assembly of successive structural modules comprising pairs of crosswise-arranged ovoid frames made from suitable resistant and flexible materials and straight frame substructures made from the same material in order to support a panel-based inner floor slab, which is covered with a shell of polymer or textile covering sheets, providing a level floor solution in which the floor is elevated above the ground using the curvature of the elliptical supporting section of each frame, obtained by combining different types of arches, or by using individual parts of retractable support in the shape of poles with an asymmetric arch head emerging from ends of the upper elliptical section of the frames.

The ovoid modular structure in combination with the articulated mechanical attachment between component frames, give this innovative type of housing a form of self tensioning geometry, while the materials chosen for these frames, composite materials and metal alloys, confer great resistance to the assembly with a very light weight. The materials and polymers used in the covering, such as, for example, thermoformed bioplastics are very adaptable and biodegradable materials, so they are easy to assemble and afterwards do not pose recycling problems.

The result is perfectly defined modular architectural units that are adaptable to the terrain and occupancy, stable, resistant and ecological that can be transported disassembled into their component parts and assembled quickly in any place anywhere, without the need of level ground, foundation work or further stabilisation. Moreover, given their structural configuration, they make possible an indigenous, to the people, type of finish, a personalised configuration and can even create xeriscape or maturation ecosystems and with reduced maintenance.

TECHNICAL FIELD

The technical field of the invention is the building of prefabricated temporary shelters, particularly residential units for emergencies caused by natural disasters among others, having the aim of social and collective public service.

The new construction system has a direct industrial application in this field of auxiliary construction, but also finds application in the field of manufacture and mechanisation of components necessary for its implementation, such as the structural frame pieces or the inner floor slab panels.

STATE OF THE ART

The mentioned construction sector of auxiliary housing and emergency units is characterised in modular prefabricated buildings without the use of concrete blocks or factory material, so that once their function is fulfilled they can be removed leaving no trace of their temporary location. Therefore this type of construction is currently resolved with metal containers and, especially with tents or modular structures with shells based on textile or polymeric materials that are becoming increasingly sophisticated.

Among the latter, those which are closest to the architectural design of the present invention are those modules with characteristics of their structural skeleton that keep them stable with a completely open interior space without needing cords, stiffening guy lines and runners typical of more traditional textile tents. Some of these structural modules have been the subject of patents, such as the Spanish utility model with publication number ES1006238-U for "Modular tent" characterised by a domed configuration formed by the functional and associative crossing of two barrel vaults on a square floor that determines a completely open interior space, or the utility model ES1026200-U, for "fold out modular shelter", consisting of articulated cross bars on interior points to form enclosures with the same or different number of modules in both perpendicular directions, but given its instability they require stiffening bars between nodes and the textile or plastic cover itself to protect the assembly. Internationally there are patents of modular structure housing with these characteristics, such as the French patent application publication number FR2697045-A1, the Canadian CA2205296-A1 or the SI21031-A.

However, none of these patents or any other sources consulted, such as scientific literature or commercial disclosures anticipate a construction model similar to the present invention, geometrical ovoid modular units, or cylindrical in general, self tensioned by the shape and mechanical articulation of their scalable components, adaptable to any type of terrain and occupancy requirements. In fact no solution for a tent or emergency shelter for very uneven terrain without additional foundation work is known.

This is definitely a new architecture that relates to a modular product that provides an improved procedure for the emergency social housing need, which is considered as the applicant's own invention.

SUMMARY OF THE INVENTION

The new architecture of adaptable modular housing presented here is an integrated technical system that defines a constructive model of architectural social emergency units, based on the assembling by successive structural modules of a housing body of oval cross-section, with an increasable and flexible extension that allows the adjustment of the volume shape factor, using different variants of adaptability of its lower half, depending on the terrain's relief and the occupation of the interior space.

The construction of this ovoid housing body is made from ovoid tubular frames which act as ribs of the main structure, each of which consists of an elliptical arch of constant curvature in its upper section, and different kinds of arches and profiles in the lower section of support on the ground, along with straight tubular frames of substructure for the support of the inner floor slab and the attachment between modules.

The materials selected for these structural frames must meet the static condition of flexibility and ductility of the assembly, preferably choosing compound materials, fibre composite type materials and metal alloys.

Each housing component module consists of two identical structural ovoid frames crossed by variable angle, preferably in a range between 48° and 90°, by the ends of their lower orthogonal axes and four straight coplanar frames in the horizontal plane of the lower substructure, inserted between the two endpoints of the elliptical upper section of each ovoid, and two others parallel, between the endpoints on the same side of the cross. Optionally, in order to gain in stability between the two crosswise-arranged ovoid frames that form each module, at the height of their major axes, are inserted substructure rods for auxiliary bracing, based on wood composites of inert nature with polyethylene. In any case, the attachment between the component modules is through straight frames inserted between the upper and lower nodes of consecutive crosswise-arranged ovoid frames.

The constructive idea of the system is to generate a structural body with self tensioning performance through the geometry of the shape, also ensured by the material's resilient capacities. In this sense, the joints between ovoid frames and linear components, modular and intramodular straight frames, are resolved through the rotational mechanical articulation, giving different degrees of freedom of movement.

The inner floor slab of the thus constituted structural skeleton is created from panels of wood or other material with a tongue and groove galvanized steel frame by coplanar coupling between adjacent panels on the lower substructure straight frames of the component modules, and in the space left between adjacent modules, by the ovoid frames of the main structure themselves.

In combination with the wood of the panels that define the physical plane of the ground, or as an alternative to this, materials with sufficient rigidity in their vertical deformation that do not affect the ultimate state of serviceability are contemplated, preferably lightweight sandwich honeycomb core type materials or materials with reinforced resins and plastic matrix.

The covering of the volumetric space is double, exterior and interior, and is preferably carried out based on sheets of textile or polymeric materials, conveniently adjusted between crosswise-arranged ovoid frames and lower side straight frames of each component module, and between the ovoid frames and upper straight frames of node attachment of adjacent modules, to close the successive spaces. Among such materials for the covering, polyester or thermoformed bioplastic sheets of the polyethylene terephthalate PETG type are proposed, suitable in all cases to the different climatic conditions of the location of the housing, maintaining in the material the concepts of biodegradability and efficiency in indoor environment.

One of the most important features of the invention is that the ovoid structure of said architectural units can adapt its support base to absorb uneven terrain or accommodate interior spaces with different requirements, according to two possibilities.

In a first embodiment the modules' adaptable support to the terrain based on the shape created by the ovoid frames themselves, is solved, since the invention provides that these can be presented as a range of up to twenty five variants of curvature of the lower elliptical section, while maintaining the tangency with the upper ellipse, designated as part S for the purpose of graphical representation herein, from the articulation of three of these other six pieces two of the five circular support arches of different radius allotted for that effect and designated as parts A, B, C, D and E, and a circular joint support arch, of constant radius and variable length depending on the variant, designated part Z, so that by the combination of said five circular support arches, arranged in pairs the twenty variants of the frames are obtained, according to five symmetrical options: AA, BB, CC, DD, EE, and ten asymmetric options in each direction: AB, AC, AD, AE, BC, BD, BE, CD, CE, DE, in one, and BA, CA, CB, DA, DB, DC, EA, EB, EC, ED, in the other. It should be noted that the elliptical arch that forms the upper section of the frame, designated as part S, can vary its curvature in all variants depending on the vertical radius to maintain tangency.

According to this model, the connection of the four component parts of each ovoid frame, corresponding to the upper elliptical section's arch, to the two support arches among the five available, and to the support attachment arch of the lower section is carried out by a mechanised clip attachment system of the ends of the parts complemented around the attachment by a top ring or special part designed to compensate joint stresses and restrict deformation.

In the second embodiment of the modules' support adaptation to the terrain, instead of multiple profiles with different support geometries for the structural frames contemplated in the initial proposal, special adjustable parts are used with different states of adaptable positioning to the external support conditions. These parts are pole-shaped with an asymmetric head and are arranged embedded by their head in the ends of the upper elliptical arch of each frame, for which it is necessary that the head has identical curvature on the highest radius exterior segment as the hollow profile of the ends of the upper arch, being these parts, in turn, linked to the crossed straight frames of the lower substructures of the floor slab of each module by both articulations on the base stem of the pole. These articulations allow the unfolding of the parts at the ends of the upper elliptical arch of each frame, which are contained in the stowed position, sliding the heads inside the hollow profile of the arch to the chosen point to overcome the uneven terrain maintaining the horizontal plane of the housing's rigid floor. A regulation is provided for the horizontal plane of the floor slab by disassembling the head arches of the parts from inside the upper arch of the frame, variable between zero and +350 mm.

The retractable support arch poles are fixed in the chosen point within the arched profile of the frame by conventional fastening means such as rivets, pins, bolts or screws, for which the arch head has a plurality of holes along its emerging surface of the horizontal plane of the floor slab.

Whether in a variant of supporting the terrain or in another, the technical qualities of this new modular construction system derive from the geometry of the architectural form of the resulting housing body, from the articulated mechanical attachment between structural components, and from the materials with which these and the covering are made. Thus, with respect to the tents and shelters currently used for the same purpose of eventuality or short term nature, for example as a result of wars or natural disasters, the new system provides:

- Constructive perfectibility.
- Greater functional adaptability to the orography of the terrain, without the need of horizontal surface support, and the interior space needs.
- Elevated rigid ground plane, which confers important benefits of habitability and protection from external conditions.
- Greater material strength.
- Improved recyclability of its components.
- Greater durability based on a simple participative maintenance.
- Better integration of environment climatic conditions.

The geometry of its architectural shape as an ovoid body with adaptable support base according to the different curvature arches, or different degrees of folding of the auxiliary arch poles, solves without environmental aggression the adaptability to any support plane of uneven terrain, and the reversibility of its construction, with no negative impact disassembly, enabling its reuse and recyclability. Notably, the installation of the housing units does not require any preparation of prior horizontal base for its support, but they are adaptable to any irregularity of the original terrain, which represents a major breakthrough in effectiveness and saving means.

Maximum performance materials such as fibre composites for the structural ribs and the blades of the interior substructure, and wood composites with polyethylene for the auxiliary bracing rods provide great strength to the assembly without affecting its flexibility.

The use of biodegradable bioplastics for the shell, such as sheets of polyethylene terephthalate (PETG) has an extraordinary potential for its obvious ecological contribution and the use of renewable natural resources, which makes it a sustainable and totally recyclable solution, also enabling easy assembly with maneuverability criteria. This material involves renewal, after bio-degradation by its users, who in a Participatory Design concept can incorporate their techniques and local materials, including in extensions and maintenance work.

Overall, this new rapid intervention architecture based on a geometrical ovoid skeleton extensible by modules with an elevated rigid ground plane adaptable to different uneven terrain implementation, plus effectively solving the basic needs of shelter, offers the possibility of generating maturation or xeriscape ecosystems, enabling integration in its structure of materials and plants representative of traditional and local values of the people affected by armed conflicts, accidents or natural disasters.

In this sense, the invention effectively addresses the needs of temporary housing with the quality standards required of emergency architecture models, allowing the solution, also with the same quality, of reduced demands for housing or extreme needs of mass groups, through an architectural design which considers material values directly related to worthy habitability, global sustainability and promotion of its occupants' health, using the following special qualities:

- Habitability: shelter space conditions adapted to the minimum development of personal skills in humanitarian emergency situations.
- Sustainability: optimisation of material resources to obtain high levels of efficiency that solves common problems in manufacturing, transportation, installation, maintenance and reuse.
- Health: definition of environmental clean areas that favour the preservation of a healthy way of life for those affected.

PLANS AND DRAWINGS

At the end of the present patent specification, the following figures are accompanied with plans and drawings showing the modular adaptable housing architecture, object of the invention:

FIG. 1: 3D assembly sequence of the ovoid structure of the housing body on which the architecture of the invention is based.

Figure 2:
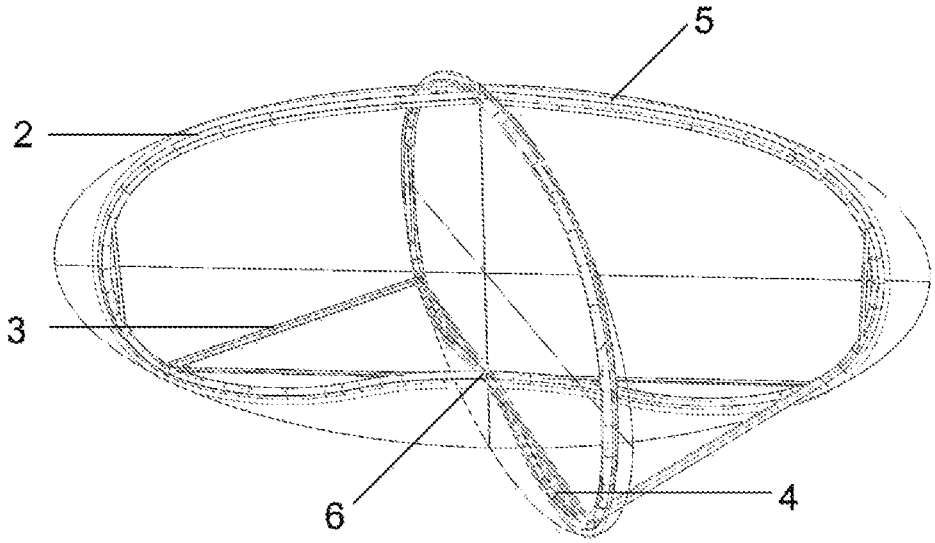

FIG. 2: 3D view of the primary structure of the component module housing body.

Figure 3:
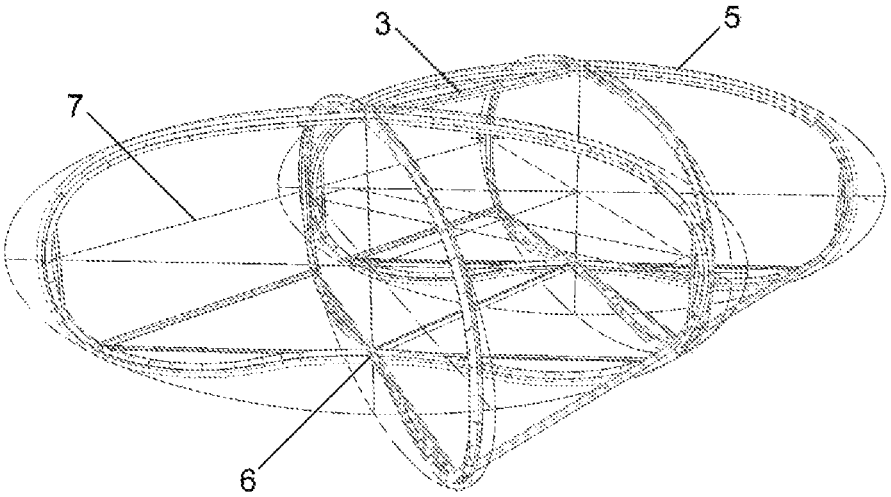

FIG. 3: 3D view of the attachment of two structural modules.

Figure 4:
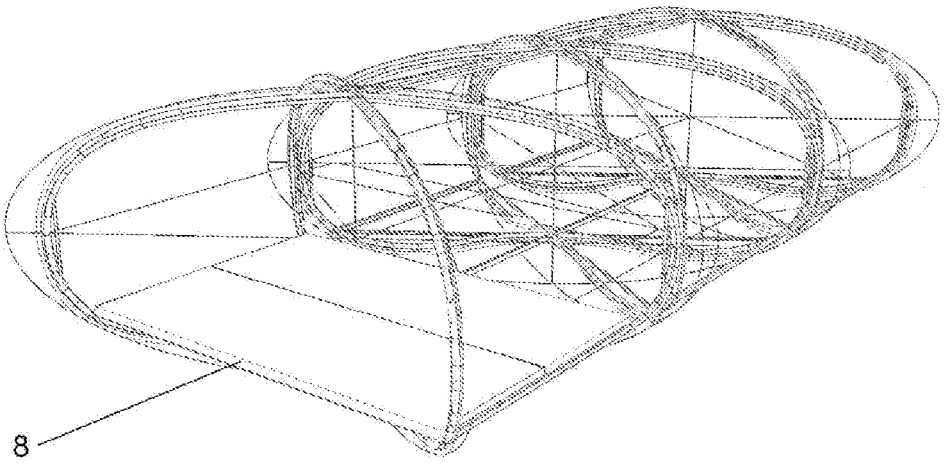
Figure 5:
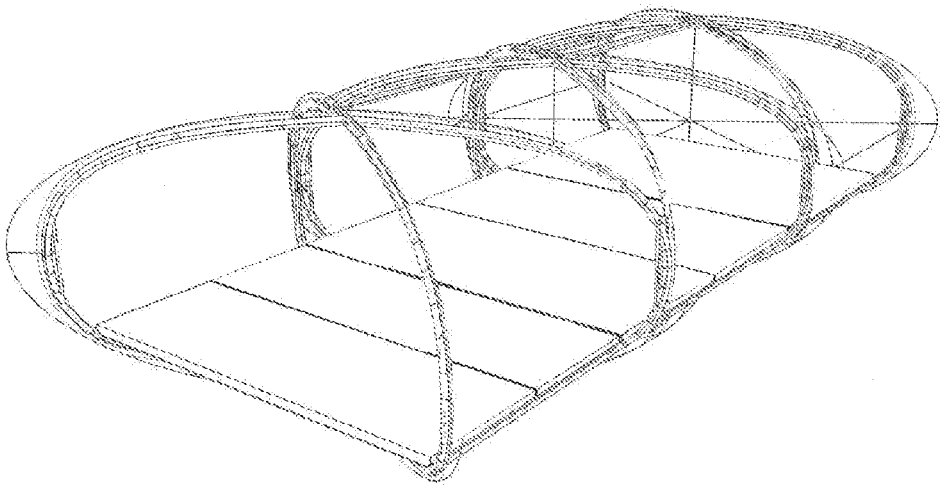

FIGS. 4 and 5: 3D view of the floor slab assembly in a body of three modules.

Figure 6:
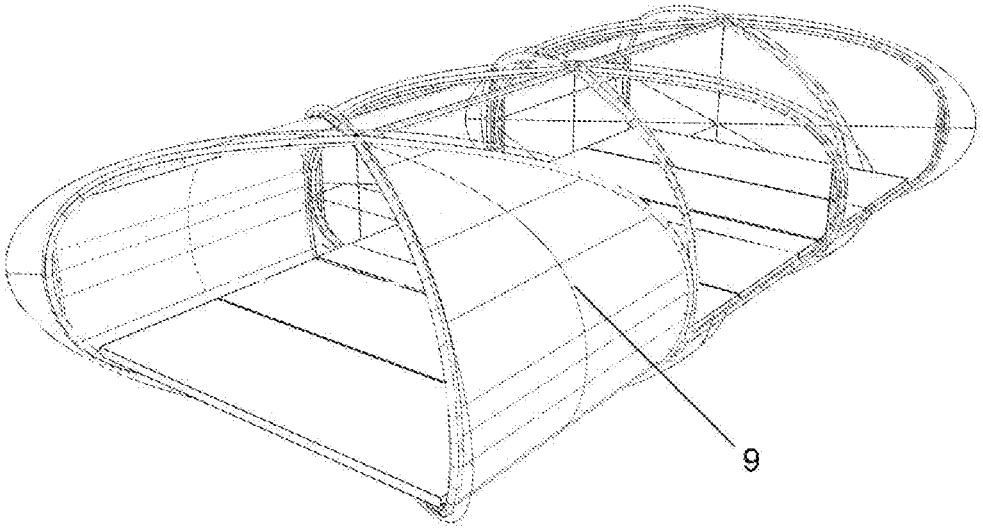
Figure 7:
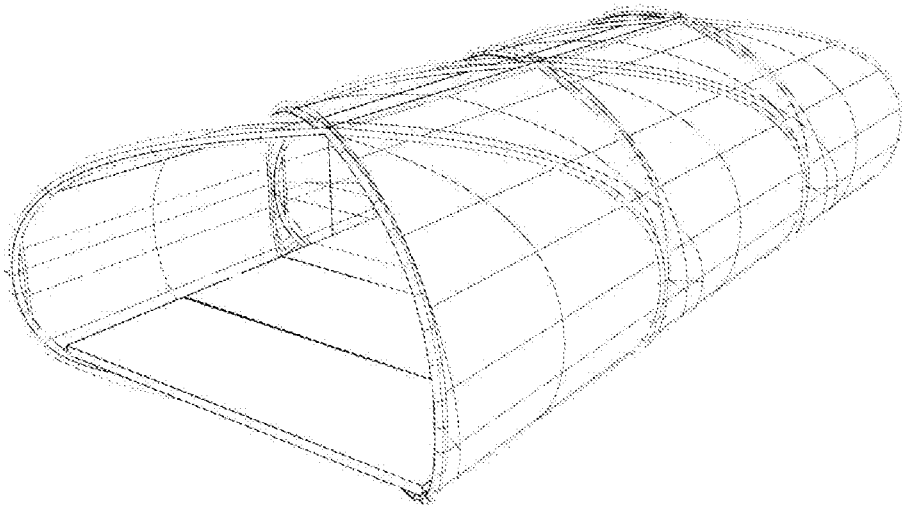

FIGS. 6 and 7: 3D view of the covering assembly in a body of three modules.

Figure 8:
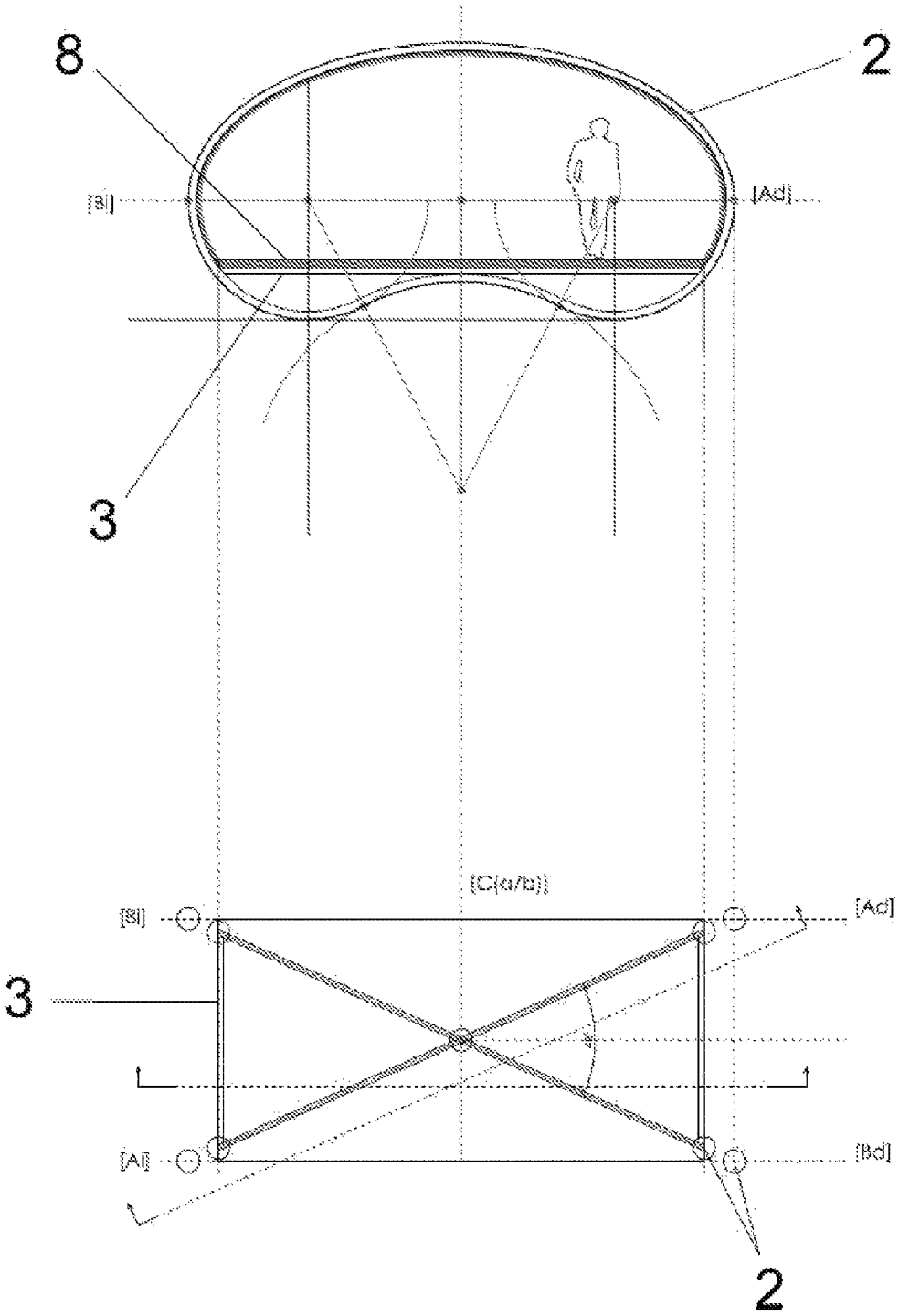

FIG. 8: Cross-sectional view of the ovoid housing body, and plan view of the framework of lower substructure frames of one the modules.

Figure 9:
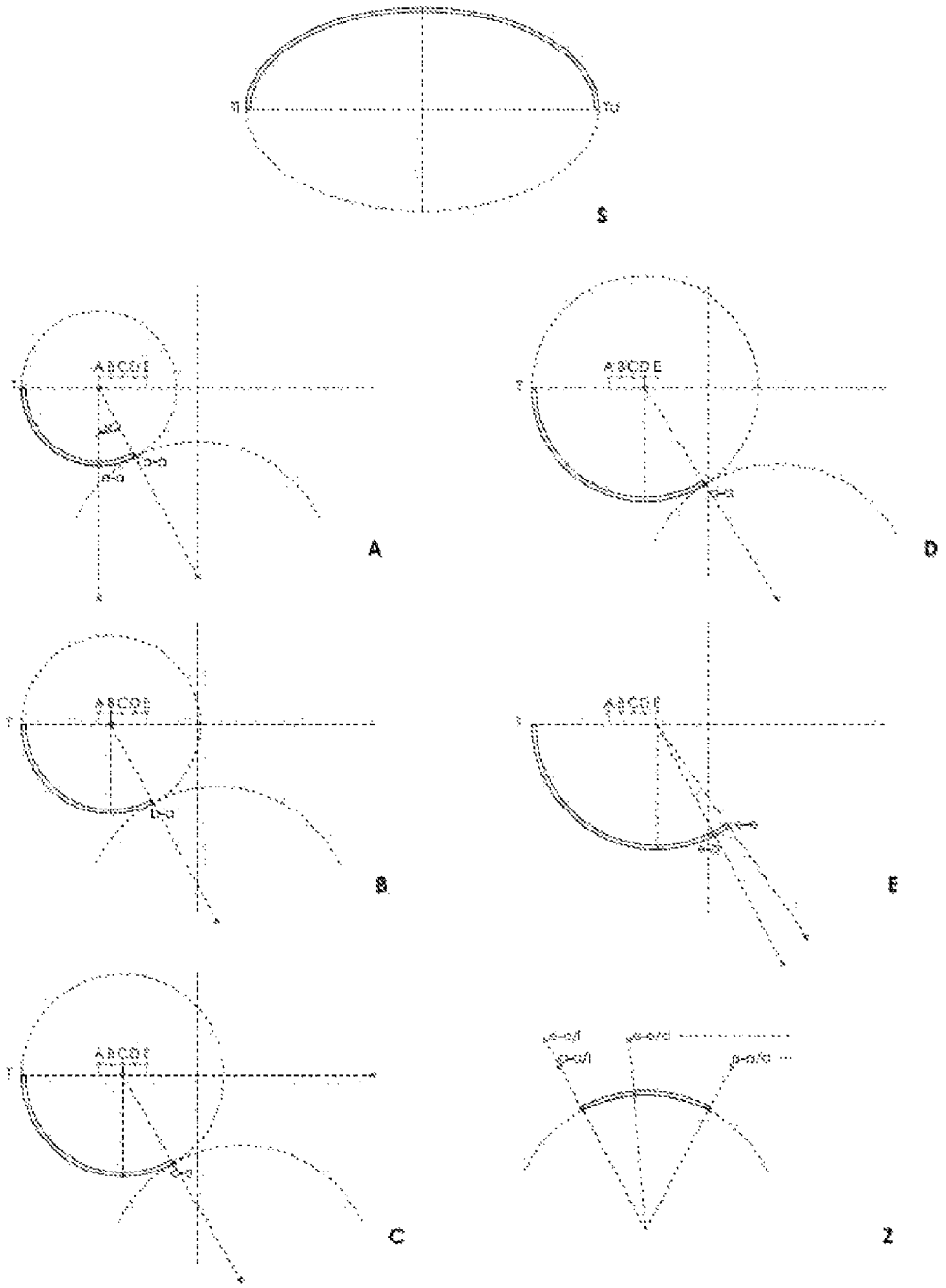

FIG. 9: Definition of the seven types of structural parts used for the assembly of the different variants of ovoid frames.

Figure 10:
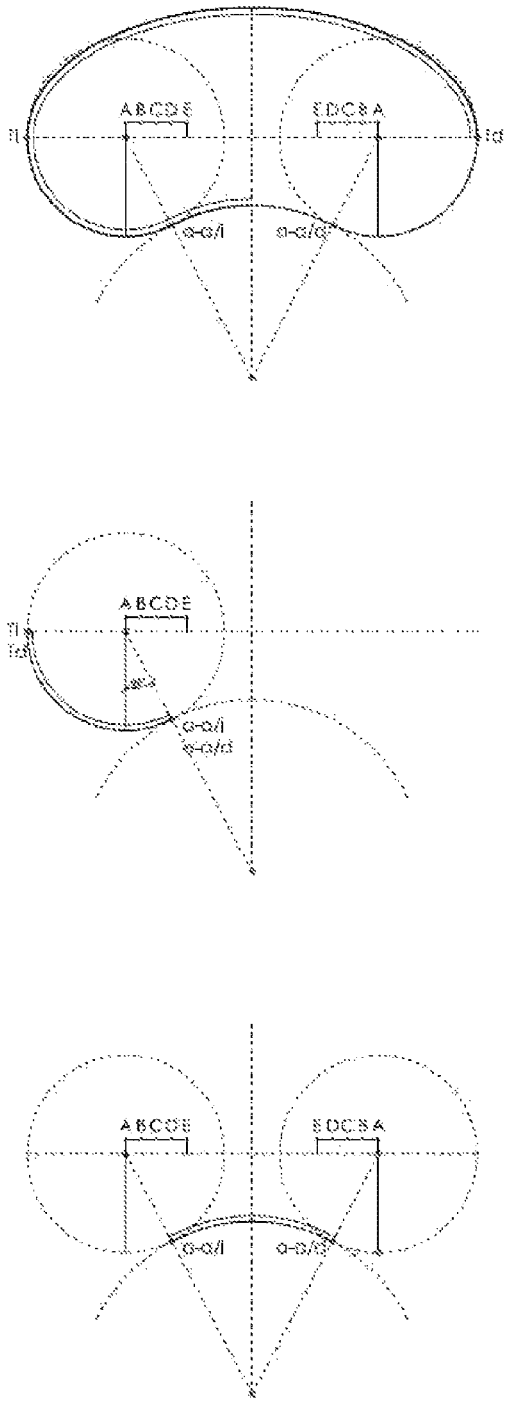

FIG. 10: Definition of an ovoid frame A-A, minimum radius symmetrical option.

Figure 11:
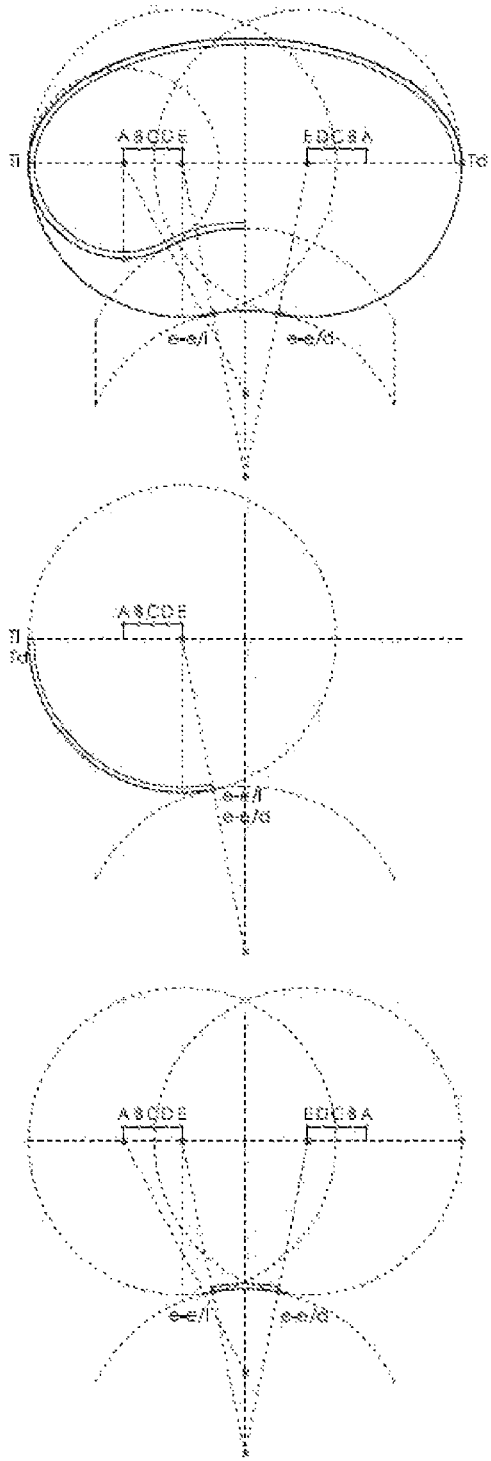

FIG. 11: Definition of an ovoid frame E-E, maximum radius symmetrical option.

Figure 12:
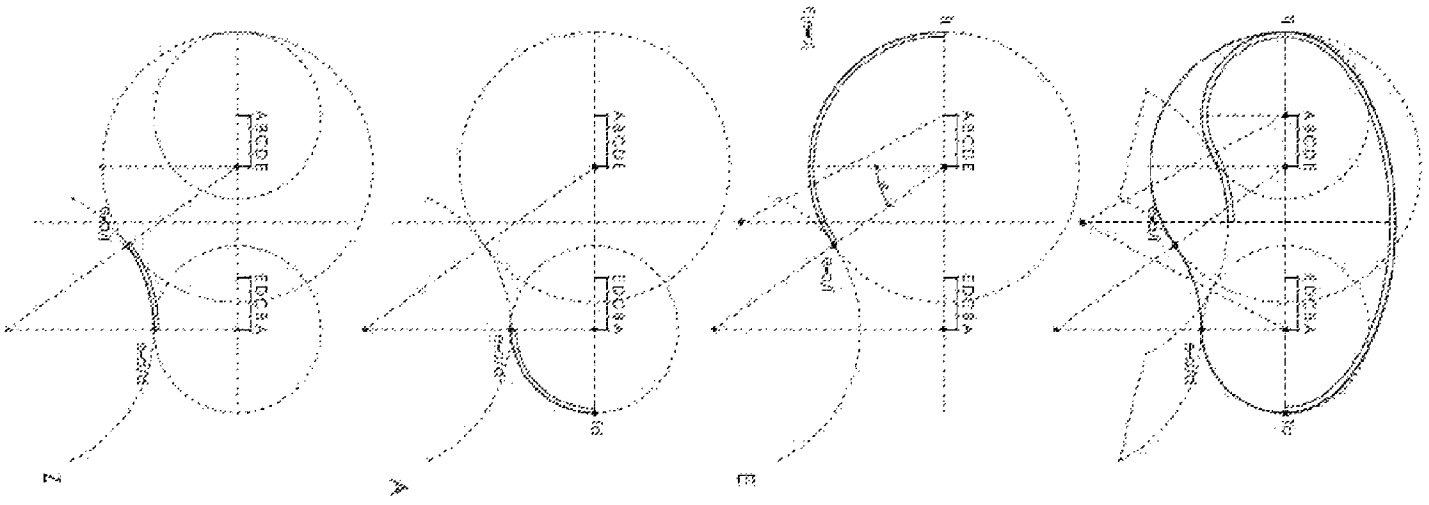

FIG. 12: Definition of an ovoid frame E-A, maximum-minimum radius asymmetrical option.

Figure 13:
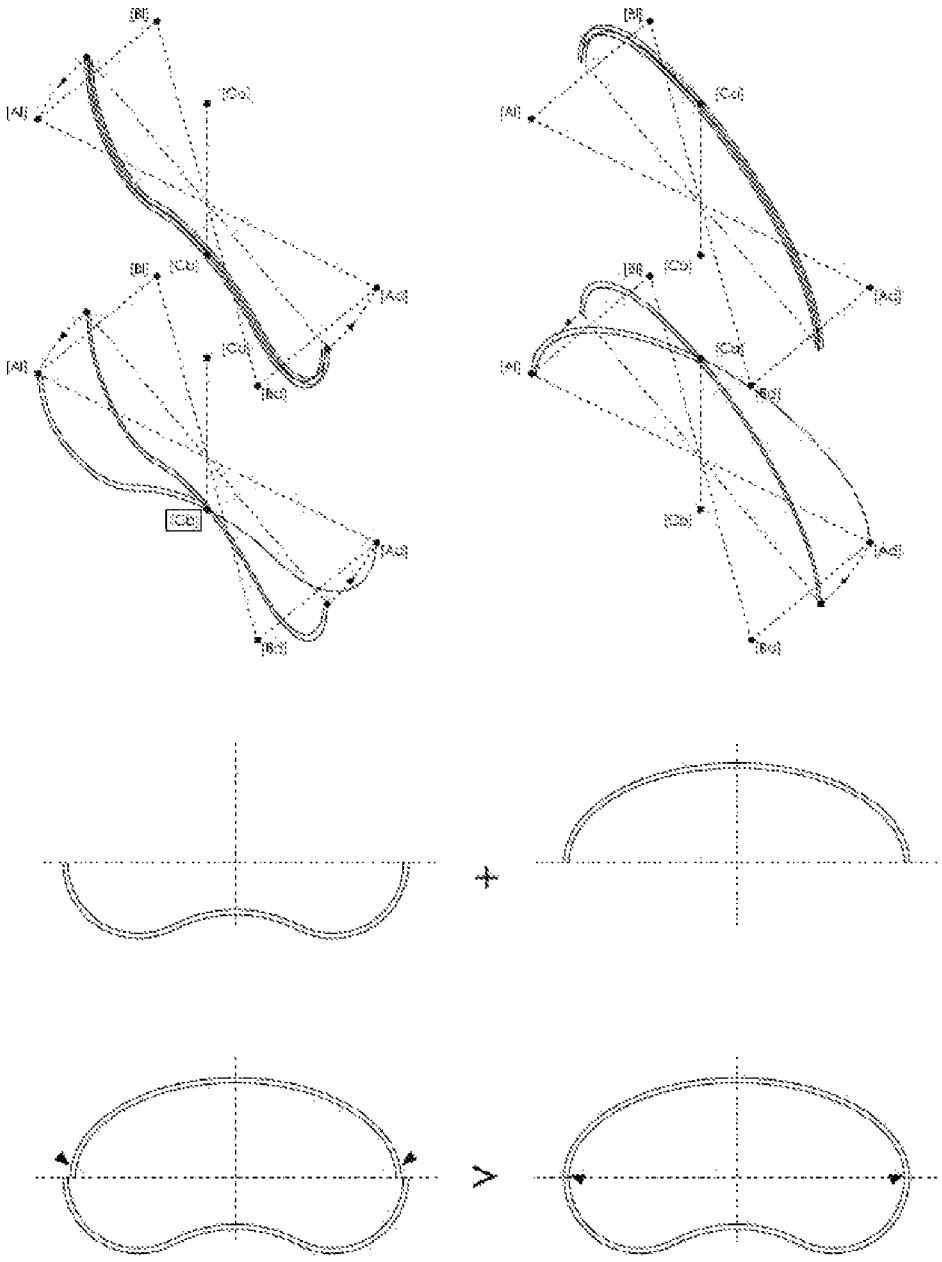

FIG. 13: 3D and 2D view of the assembly of the ovoid structure of a type module, by unfolding of the crossed frames of the upper and lower sectors, and clip system joint.

Figure 14:
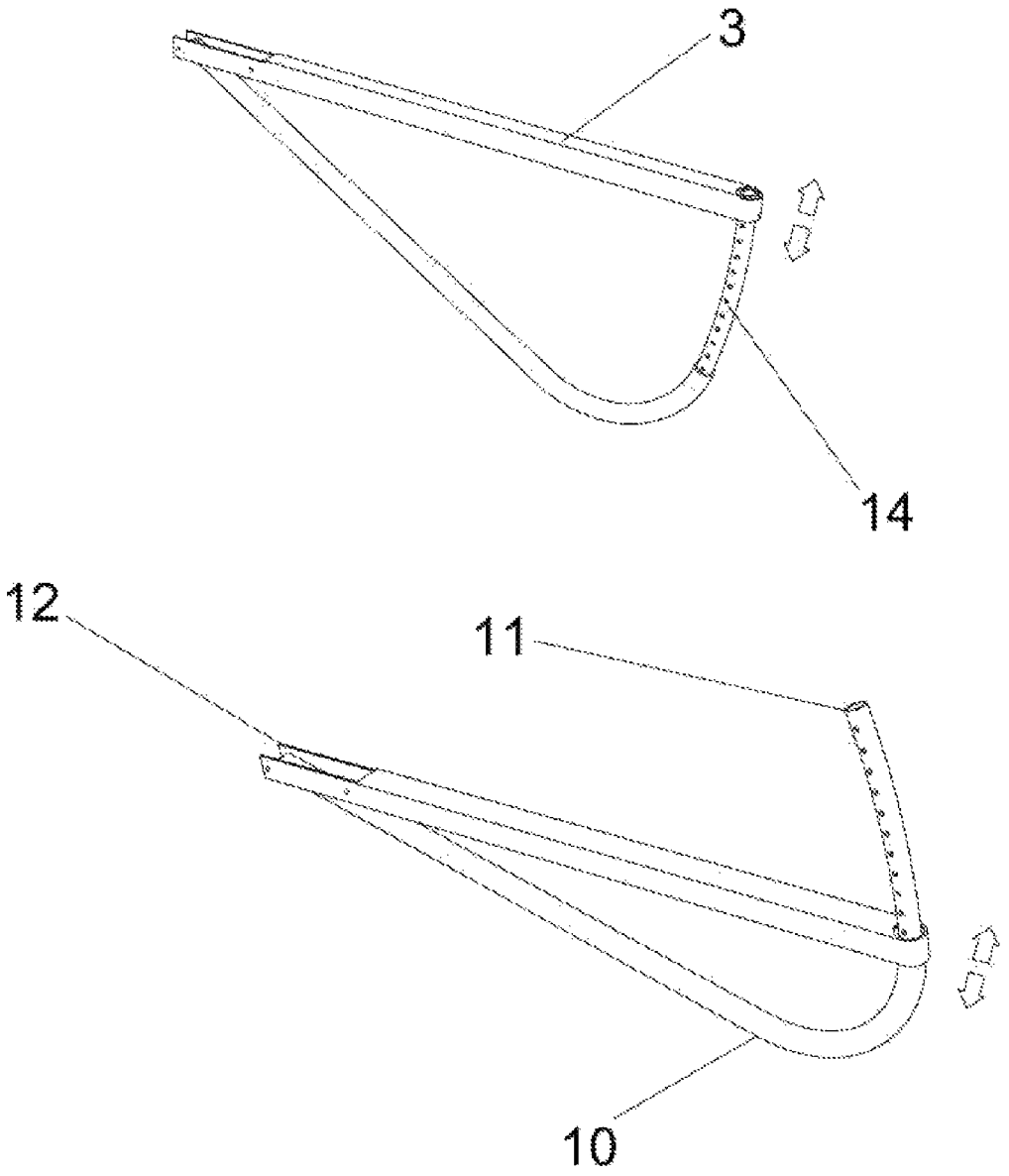

FIG. 14: Perspective view of the retractable arch support poles for the adaptation of the floor slab to the ground, in the unfolded position (top drawing) and in the retracted position (bottom drawing).

Figure 15:
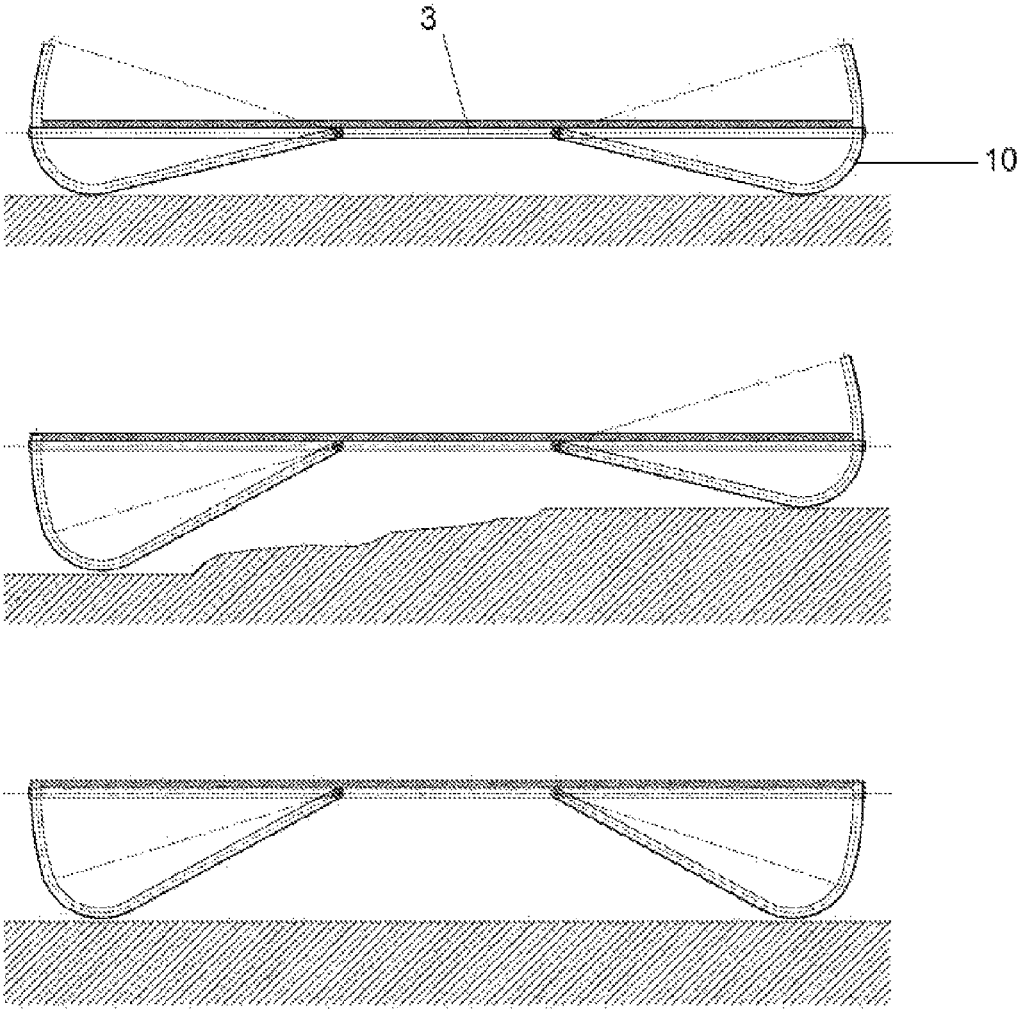

FIG. 15: Cross-sectional view of the plane of the floor slab of the ovoid body of the housing with retractable arch support poles, in lower and upper position on level ground (pictures above and below), and in intermediate position overcoming a slope on the left side (drawing in the middle).

MODE FOR CARRYING OUT THE INVENTION

Structural Arrangement:

In view of the above figures, it is proved that the constructive body modular housing resulting from the new architecture for social emergency, is based on the interconnection of unitary structural modules (FIG. 2) formed by mechanical articulation of two crosswise-arranged ovoid frames (2) to variable Angle by the ends of its minor axes and four straight frames (3) on the same plane, two of them cross-arranged along the line of tangency of the lower elliptical section of each ovoid, and another two parallel, between the endpoints on the same side of those crossed, with the optional possibility of alternating at the height (7) of major axes ends of the ovoids, substructure poles for auxiliary bracing. The attachment between successive modules (FIG. 3) is performed by straight frames between the upper (5) and lower (6) nodes of consecutive crosswise-arranged ovoid frames. Thus, by means of flexible extension of the component unitary modules, the skeleton of the housing body in composite materials or of metal alloys, which provide it with strength and flexibility, as well as self-tensioned by the geometry of its shape and mechanical articulations of the joints, is created.

Once the structural skeleton is constituted, the assembly of the inner floor slab and the covering shell are easy. The floor slab (FIGS. 4 and 5) is mounted by tongue and groove joint of panels (8) on the modules' substructure lower framework, and the covering (FIGS. 6 and 7), for which textile or polymeric sheets (9) are used, such as PETg bioplastics, suitably adjusted between ovoid and straight frames.

The possibility offered by the new construction model to adapt the geometrical shape of the structural modules according to the unevenness of the terrain and to the inner occupation needs, is achieved as explained according to two alternative embodiments.

One of them is suitably adapting the curvature of the lower elliptical section of the ovoid frames, creating a range of twenty frame variants by the articulation of four of seven possible parts geometrically designated and defined in FIG. 9 by parts A, B, C, D, E, S and Z. From these parts, part S, upper section of constant curvature of the ovoid, is common in all variants, and part Z of attachment between supporting arches only varies in length, so the two supporting arches that have been chosen among the five of different possible radius, parts A, B, C, D and E, from lower to higher, will be the arches that will determine the twenty five different curvatures of the lower elliptical ovoid section.

Thus, for example, an ovoid frame of AA type (FIG. 10), with higher Z, will be the symmetrical option of minimum applicable radius to overcome pronounced mounds, given the curvature of its inner section; an EE ovoid frame (FIG. 11) with lower Z, will instead be the symmetrical option of maximum applicable radius to land depressions; and an EA ovoid frame (FIG. 12) and medium Z, the asymmetric option of maximum-minimum radius, applicable to sloping terrains. The combination or progressiveness between different geometrical positions on changes of slope in the terrain or in the inner space is also possible.

The other way of adapting the floor slab to the terrain is unfolding the poles of retractable arch supporters (10) that are embedded in its stowed configuration by both sides of the upper arch from the structure of the frame, which enables a variable regulation of each side of the module between zero and 5+350 mm, this without interfering in the upper elements, i.e., covering and floor.

These poles of lower support are linked by an articulation (12) to the horizontal bar (3) of floor support and enables sliding its head with an asymmetric-arch shape (11) to the chosen point and definitely fix it through the curve inner profile of the frame, or readjust if necessary, to which holes (14) along the emerging arch surface from the floor plan are arranged.

Transfer and Assembly.—

The articulation of the frames from separate parts is very important in order to facilitate packaging and transporting the material, comprising said parts, straight frames, auxiliary poles, inner floor panels and shell sheets conveniently folded, without forgetting the asymmetric arch poles if the formula for retractable support to the terrain is chosen. In fact, the material solution chooses a version of immediate initial assembly as a kit packaged, transported and installed, to resolve urgent contingencies of habitability and use.

The construction of the housing units is carried out in two phases; a first phase of fast sequences for basic installation of the shelter, i.e., the modular body with covering and floor shown in FIG. 7; and within the time limits of biodegradable obsolescence, a second phase of progressive improvement by introducing the local participative concept of its inhabitants.

In the first phase, from the construction of the architectural units until they are ready for use, the process of assembling the two crosswise-arranged frames of each structural module in the embodiment that does not require the use of auxiliary supporting poles should be noted, comprising the following steps represented in FIG. 13:

1) Provision of four types of component parts of the chosen frame: the S part of upper elliptical arch, the two appropriate from available five parts, A, B, C, D and E, for the circular arches of support, and the Z part of circular arch of supporting joint, of suitable length to the corresponding variation, multiplied by the two constituent module frames.

2) Connection of the three component parts of the lower elliptical section of each of the two frames by a mechanised clip attachment system of its ends and a top ring or special part designed to compensate joint stresses and limit the deformation, and linking the two resulting sections by superimposing both of them and the rotational mechanical articulation at the corresponding point to the centre of the horizontal between the ends, like scissors. The upper elliptical section releases its previous deformation tension by entering the lower section, resulting in a geometrically rigid system.

3) Linking the two upper elliptical section arches of the two same-shaped frames by superimposing the arches and mechanical articulation of rotation at the corresponding point central to the horizontal and the ends, like scissors; and 4) Unfolding of elliptical sections of the upper and lower substructures faced by its ends, and a mechanised clip attachment system, with a top ring around the compensation and the deformation restriction joint From here, the interconnection between structural modules and the floor slab assembly and shell covering, is easy to understand as described above in relation to the drawings for any person skilled in the art.

What is claimed is:

1. A modular adaptable housing architecture for building temporary shelters and residential units in emergency situations, comprising:

an oval cross-section housing body having:

two tubular ovoid frames made of one of composite fibers and a metal alloy, wherein the tubular ovoid frames act as ribs of the oval cross-section housing body, and wherein the tubular ovoid frames have an upper section with an elliptical arch having a constant curvature and a lower section having an arch and a curvature different from the constant curvature of the upper section to support a ground, and four straight tubular frames made of one of composite fibers and a metal alloy for supporting an inner floor slab, wherein the tubular ovoid frames and the straight tubular frames form a first module of the modular adaptable housing architecture, wherein the straight tubular frames are designed to facilitate attachment between at least two modules, wherein the first module is formed by crossing the two ovoid frames to create a variable angle at the ends of lower orthogonal axes and at four straight coplanar frames in a horizontal plane of the oval cross-sectional housing body, wherein two of the straight tuber frames are crossed and inserted between the upper elliptical sections of each tubular ovoid frame, wherein two of the straight tuber frames are parallel and located between the ends of the crossed straight tuber frames and are adapted to be linked to a second module by inserting straight tubular frames between upper nodes and lower nodes at the cross-arranged ovoid frames and straight frames, and wherein joints between the ovoid and straight frames are resolved by rotational mechanical articulation.

2. The modular adaptable housing architecture of claim 1, wherein the two tubular ovoid frames forming each module are unfolded at an Angle between 48° and 90°.

3. The modular adaptable housing architecture of claim 1 wherein the two tubular ovoid frames used as structural ribs solve the module's adaptive ground support through different curvatures of the lower elliptical section, while maintaining the tangency with the upper elliptical arch (designated as part S) obtained by the articulation of three of the other six parts: two of the five circular supporting arches of different radius provided for this purpose, ordered from lower to higher radius (as parts A, B, C, D and E) and a circular arch of support joint, of constant radius and variable length depending on the variant (designated as part Z) so that by combining said circular supporting arches arranged in pairs, the twenty-five frame variants are obtained, according to five symmetrical operations (AA, BB, CC, DD, EE), and ten asymmetric options in each direction (AB, AC, AD, AE, BC, BD, BE, CD, CE, DE, in one, and BA, CA, CB, DA, DB, DC, EA, EB, EC, ED, in the other).

4. The modular adaptable housing architecture of claim 3, wherein the curvature of the elliptical arch that forms the upper section of the ovoid frame (designated as part S) varies according to the vertical radius in order to conserve the tangency with the lower section.

5. The modular adaptable housing architecture of claim 3 wherein the connection of the four component parts of each structural ovoid frame, corresponding to the upper elliptical section arch, to the two supporting arches among the five available, and to the support attachment arches of the lower section is made by a mechanised clip attachment system of the ends of the parts and a top ring around a joint to compensate the joint stresses and limit deformation.

6. The modular adaptable housing architecture of claim 1 wherein the two ovoid frames used as structural ribs solve the adaptable support to the ground of the modules by unfolding at the ends of each upper elliptical arch of two tubular pole shape parts with an asymmetric arch head, of the same curvature in its outer segment of highest radius as the empty profile of the ends of the upper arch structure, where they are embedded in the stowed position, these parts being linked to the crossed straight frames of lower substructure of the floor slab of each module by means of respective joints in the end of each pole, that enable sliding of the arches head inside the empty profile of the upper arch to the chosen point, where the parts are fixed by conventional fastening means, such as intern rivets or screws, for which head arches have a series of holes along its emerging surface of the floor slab's horizontal plane or elevated rigid floor.

7. The modular adaptable housing architecture of claim 4 wherein the tubular pole-shaped parts with asymmetric arch head for adaptive ground support, enable a regulation of the horizontal plane by disassembling the headed arches from inside the upper arch, variable from zero to +350 mm.

8. The modular adaptable housing architecture of claim 1 further comprising:

substructure poles for auxiliary bracing based on wood composites of inert nature with polyethylene inserted at the height of the ends of the higher axes and between the two crosswise-arranged ovoid frames that form the module.

9. The modular adaptable housing architecture claims 1 wherein the inner floor slab of the housing body consists of panels of wood or other material with a tongue and groove galvanized steel frame by coplanar coupling between adjacent panels on the lower substructure straight frames of the component modules, and in the space left between adjacent modules, by the ovoid frames of the main structure.

10. The modular adaptable housing architecture of claim 9 wherein the inner floor slab panels are made of light weight sandwich honeycomb core type materials, or materials with reinforced resins and plastic matrix.

11. The modular adaptable housing architecture of claim 1 further comprising:

a shell of covering sheets of textile or polymeric materials, conveniently adjusted between crosswise-arranged ovoid frames and lower side straight frames of each component module, and between the ovoid frames and upper straight frames of node union of adjacent modules, to close the successive spaces.

12. The modular adaptable housing architecture of claim 11 wherein the covering sheets are made of polyester.

13. The modular adaptable housing architecture of claim 11 wherein the covering sheets are thermoformed bioplastic sheets of the polyethylene terephthalate PETG type.

* * * * *